US006330019B1

(12) United States Patent
Kubokawa

(10) Patent No.: US 6,330,019 B1
(45) Date of Patent: Dec. 11, 2001

(54) IMAGE RECORDING APPARATUS AND OPTICAL RECORDING HEAD

(75) Inventor: Hideji Kubokawa, Chigasaki (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/392,653

(22) Filed: Sep. 9, 1999

(30) Foreign Application Priority Data

Nov. 13, 1998 (JP) ..... 10-324111
Nov. 18, 1998 (JP) ..... 10-328292
Nov. 19, 1998 (JP) ..... 10-329762

(51) Int. Cl.[7] ..... B41J 15/14
(52) U.S. Cl. ..... 347/241; 347/242
(58) Field of Search ..... 347/233, 241, 347/256, 242; 65/406, 409; 385/54, 59, 63, 65, 76, 83, 98, 120, 137, 89; 216/24; 358/484

(56) References Cited

U.S. PATENT DOCUMENTS 3,864,018 * 2/1975 Miller ..... 385/98
4,046,454 * 9/1977 Pugh, III ..... 385/59
4,364,064 * 12/1982 Baues ..... 347/241
5,006,201 * 4/1991 Kaukeinen ..... 216/24
5,109,460 4/1992 Baek et al. ..... 385/115
5,539,444 * 7/1996 Ikeda et al. ..... 347/241
5,742,720 * 4/1998 Kobayashi et al. ..... 385/89
5,996,376 * 12/1999 Johnson et al. ..... 65/406

FOREIGN PATENT DOCUMENTS 5-281423 10/1993 (JP) .
6-47954 2/1994 (JP) .
7-214803 8/1995 (JP) .
8-286069 11/1996 (JP) .

* cited by examiner

*Primary Examiner*—Hai C. Pham
(74) *Attorney, Agent, or Firm*—Greenblum & Bernstein P.L.C.

(57) ABSTRACT

The terminations of the optical fibers are placed on columns L1 in the sub-scanning direction of a recording medium and fixed in such a way that columns L1 are stacked in multiple stages in the main scanning direction of the recording medium. In this way, the terminations form a matrix made up of 8 columns L1 in the sub-scanning direction of the recording medium and 16 rows L2 in the main scanning direction of the recording medium that intersect columns L1. The terminations of a plurality of optical fibers which belong to same columns L1 are arrayed with pitch P. With respect to a perpendicular that passes through center C of the termination of one optical fiber, center C of the termination that belongs to another column L1 and same row L2 at the same time is uniformly shifted by an amount of shift S in the sub-scanning direction. Thus, the present recording apparatus achieves improvements in both the recording speed and resolution at the same time.

5 Claims, 7 Drawing Sheets

IMAGE RECORDING APPARATUS AND OPTICAL RECORDING HEAD

BACKGROUND OF THE INVENTION

1. Field of the Invention

The present invention relates to an image recording apparatus that irradiates a recording medium with light beams and forms an image on this recording medium, and an optical recording head used for this image recording apparatus.

2. Description of the Related Art

The following image recording apparatus is known: This image recording apparatus irradiates with laser beams a sheet-like recording medium with subliming dyestuff applied on a base film. This image recording apparatus selectively eliminates the subliming dyestuff by the thermal energy of these laser beams forming an image with the subliming dyestuff on the surface of the recording medium.

Such an image recording apparatus uses a drum winded with a recording medium, spins this drum to rotate the recording medium in the main scanning direction. While moving the laser head in the sub-scanning direction it irradiates this recording medium with laser beams. The laser beams irradiated are converged onto the surface of the recording medium by an optical lens.

To improve the processing speed by increasing the number of points recordable at a time, the laser head has an array of a plurality of optical fibers in the sub-scanning direction at regular intervals in a row. Thus, the resolution is determined by the distance between two neighboring optical fibers. To achieve recording with higher resolution, substrates that fix optical fibers may be tilted so as to substantially shorten the distance between two neighboring optical fibers in the sub-scanning direction.

By placing optical fibers in a row in the sub-scanning direction and increasing the number of optical fibers it is possible to increase the number of points recordable at a time improving the recording speed. However, the higher the number of optical fibers, the longer the optical fiber row becomes. When the length of an optical fiber row increases, the difference between the center and ends of the row in the distance between an optical fiber and the recording medium increases. This difference in the distance causes the laser beams to be out of focus deteriorating the picture quality. Furthermore, a longer optical fiber row requires not only an optical system lens of a greater diameter but also a greater laser head.

Furthermore, when tilting the substrates to obtain higher resolution, they must be tilted accurately, which would require the image recording apparatus to be provided with a controller for controlling the inclination of the substrates, which would mean additional costs.

Moreover, improving resolution requires the angle of tilting the substrates to be increased. However, a greater angle may cause the inconvenience of increasing the possibility of different laser beams overlapping one another.

SUMMARY OF THE INVENTION

It is an objective of the present invention to provide an image recording apparatus capable of improving the recording speed and picture quality.

To achieve this objective, the present invention provides a plurality of light sources placed in the sub-scanning direction in multiple stages in the main scanning direction and shortens the distance between the focuses of two neighboring beams irradiated onto the surface of a recording medium in the sub-scanning direction, achieving the formation of an image with high resolution.

Another objective of the present invention is to provide an optical recording head capable of recording images of high picture quality at a high speed with a simple configuration.

To achieve this objective, the present invention makes up a fixing material that fixes terminations of optical fibers of at least 2 flat materials that hold the terminations of optical fibers, forms grooves that position the terminations of optical fibers on at least one side of the flat material above, arranges these grooves on columns along the sub-scanning direction of the recording medium above and fixes the terminations above in such a way that the columns above are stacked in multiple stages in the main scanning direction of the recording medium above. In this way, the present invention provides a plurality of optical fiber terminations arrayed in the sub-scanning direction in multiple stages in the main scanning direction, and places the optical fiber terminations in a matrix form made up of the optical fiber terminations shifted between the upper and lower rows in the sub-scanning direction.

Another objective of the present invention is to provide an optical recording head capable of positioning optical fibers with high precision using a simple configuration.

In order to achieve this objective, the present invention forms grooves on two substrates to fix the optical fibers and positions the optical fibers with high precision using these grooves.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

With reference now to the attached drawings, the embodiment of the present invention is explained in detail below.

Figure 1:
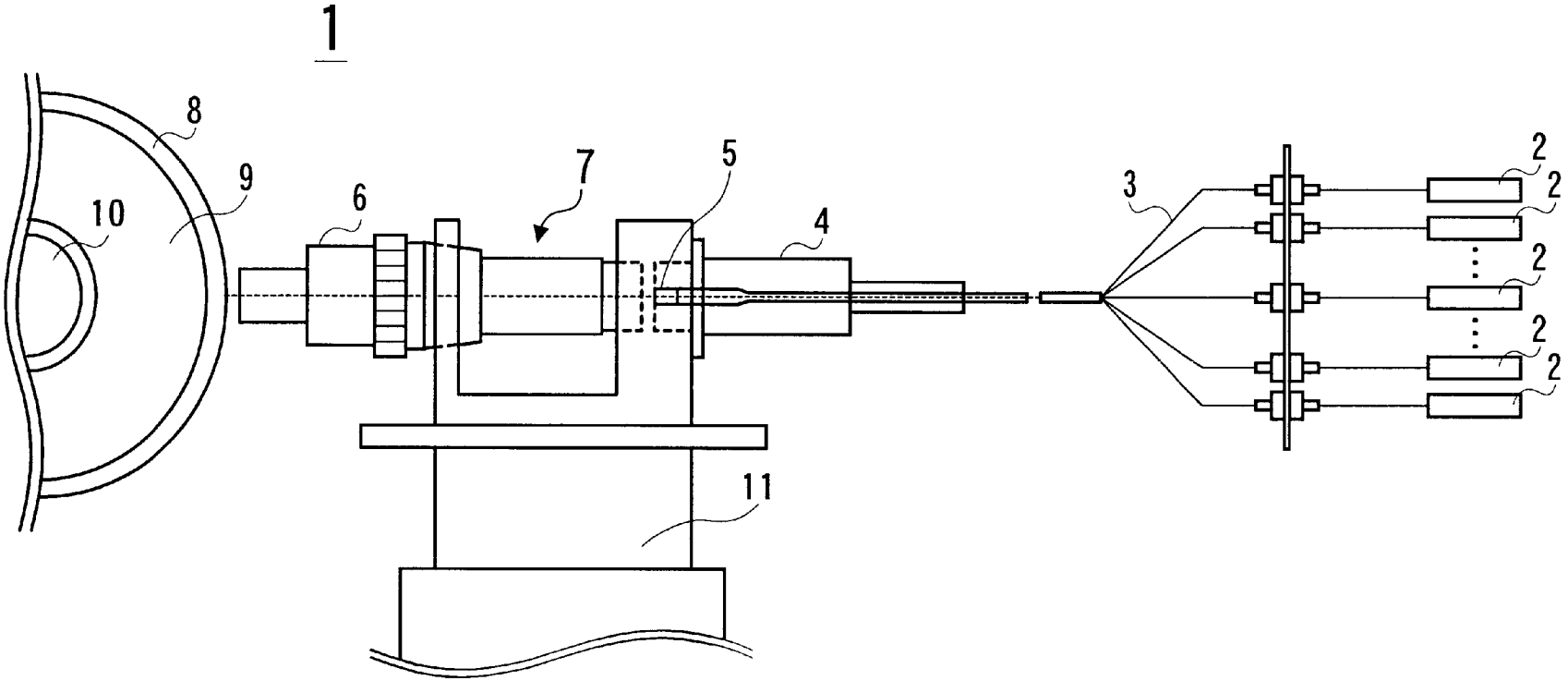
FIG. 1 is an overall schematic diagram showing an image recording apparatus of an embodiment of the present invention.

FIG. 1 is an overall schematic diagram of an image recording apparatus of an embodiment of the present invention. A image recording apparatus 1 comprises a plurality of semiconductor lasers 2 that generate laser beams for recording. The semiconductor lasers 2 are connected to optical fibers 3 to propagate their respective light beams. The parts of the optical fibers 3 near their terminations are bundled together by an optical fiber array 4. The optical fiber array 4 is provided with a fixing block 5 to fix the parts from which light beams are emitted (hereinafter referred to as "emitters"). On the light beam emitting side before fixing block 5 is zoom lens 6 that reduces or enlarges light beams. The optical fiber array 4 together with zoom lens 6 is hereinafter referred to as "laser head 7."

At the focal position of light beams of the zoom lens 6 is a drum 9 with a recording medium 8 attached to its circumferential surface. The recording medium 8 is recorded image data. The rotation axis of this drum 9 is connected with a motor 10 that turns drum 9. Driven by this motor 10, the recording medium 8 moves in the main scanning direction. On the other hand, the laser head 7 is supported by a linear motor 11. This linear motor 11 moves in the axial direction of the drum 8. This allows the laser head 7 to move in the sub-scanning direction of the recording medium 8.

Figure 2:
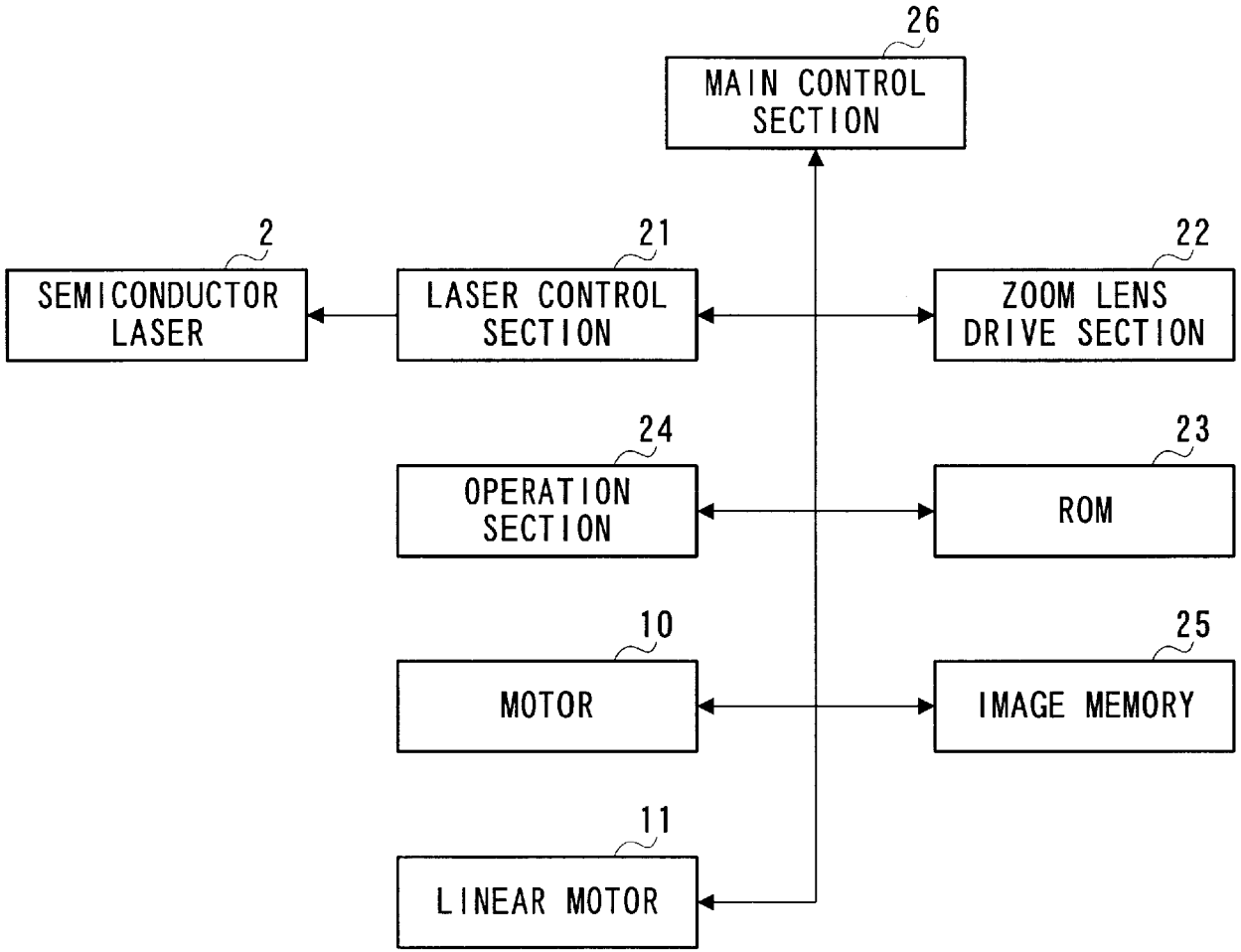
FIG. 2 is a block diagram showing a control system of the image recording apparatus of the embodiment above.

Then, a control system of the image recording apparatus of the embodiment above is shown in a block diagram in FIG. 2 The same parts as those in FIG.1 are assigned the same numbers and their explanations are omitted.

In FIG. 2, a laser control section 21 drives and controls the semiconductor laser 2. A zoom lens drive section 22 controls the magnifying of zoom lens 6. A ROM 23 stores a control table that shows the correspondence between the resolution and magnifying of zoom the lens 6. An operation section 24 sets the resolution, etc. of this apparatus. An image memory 25 stores image data to be recorded. A main control section 26 controls sections 21 to 25.

Then, the fixing block of the optical fiber array 4 of the laser head 7 is explained with reference to FIGS. 3 to 7.

Figure 3:
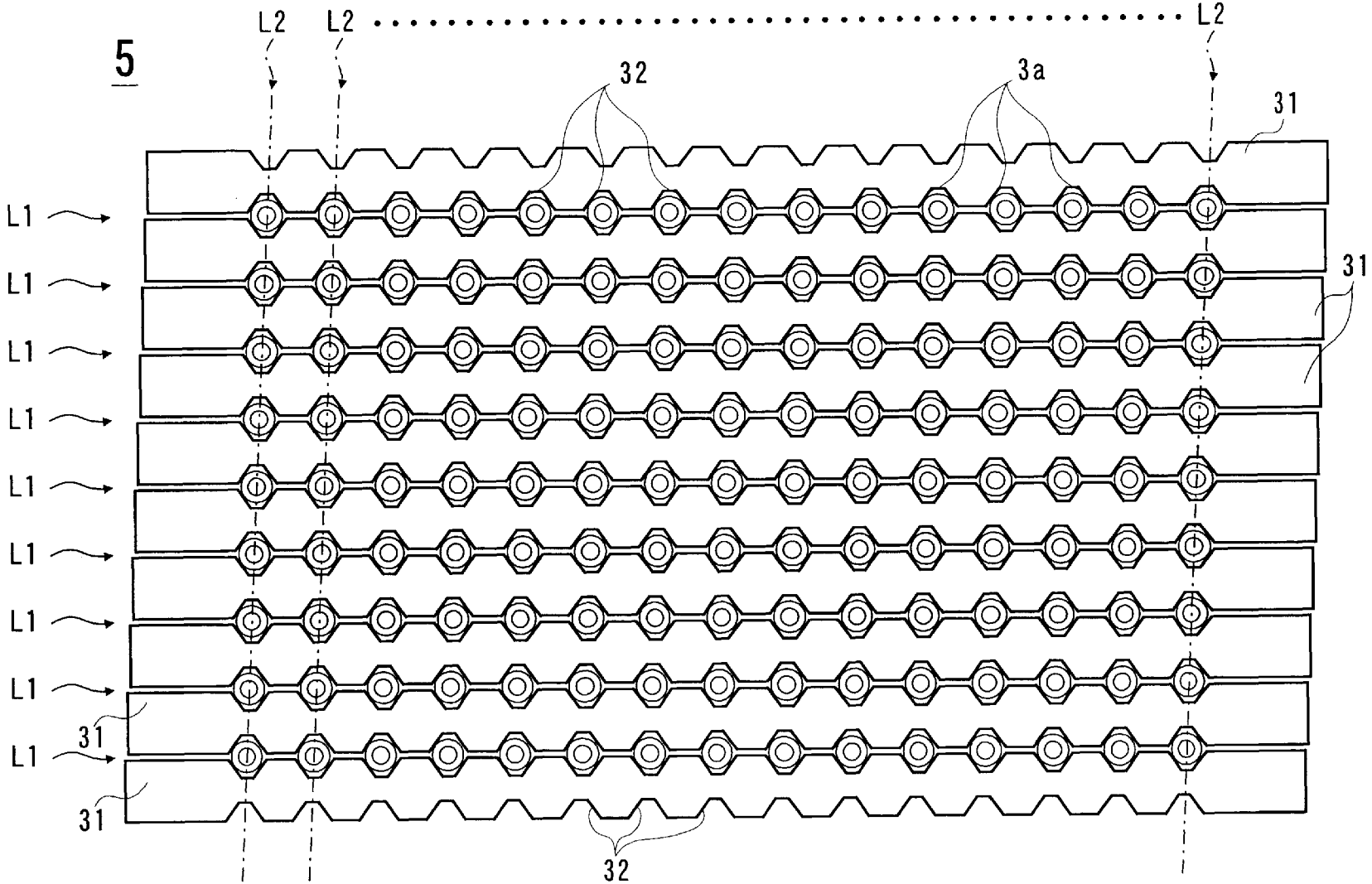
FIG. 3 is a front view showing a fixing block of the image recording apparatus of the embodiment above.

FIG. 3 is a front view showing the fixing block of the image recording apparatus of the embodiment above. The fixing block 5 consists of a plurality of flat substrates 31. On the front and back sides of the substrates 31, a plurality of grooves 32 are formed substantially perpendicular to the front side of the substrates 31 and substantially parallel to one another.

A plurality of the substrates 31 are stacked. Here, two neighboring substrates 31 are placed in such a way that their respective grooves 32 formed on the facing surfaces align. Between facing the grooves 32, terminations 3*a* of the optical fibers 3 are inserted and fixed. The terminations 3*a* of the optical fibers 3 are exposed from the front of the fixing block 5. The substrates 31 are mutually glued with an adhesive for example.

Figure 4:
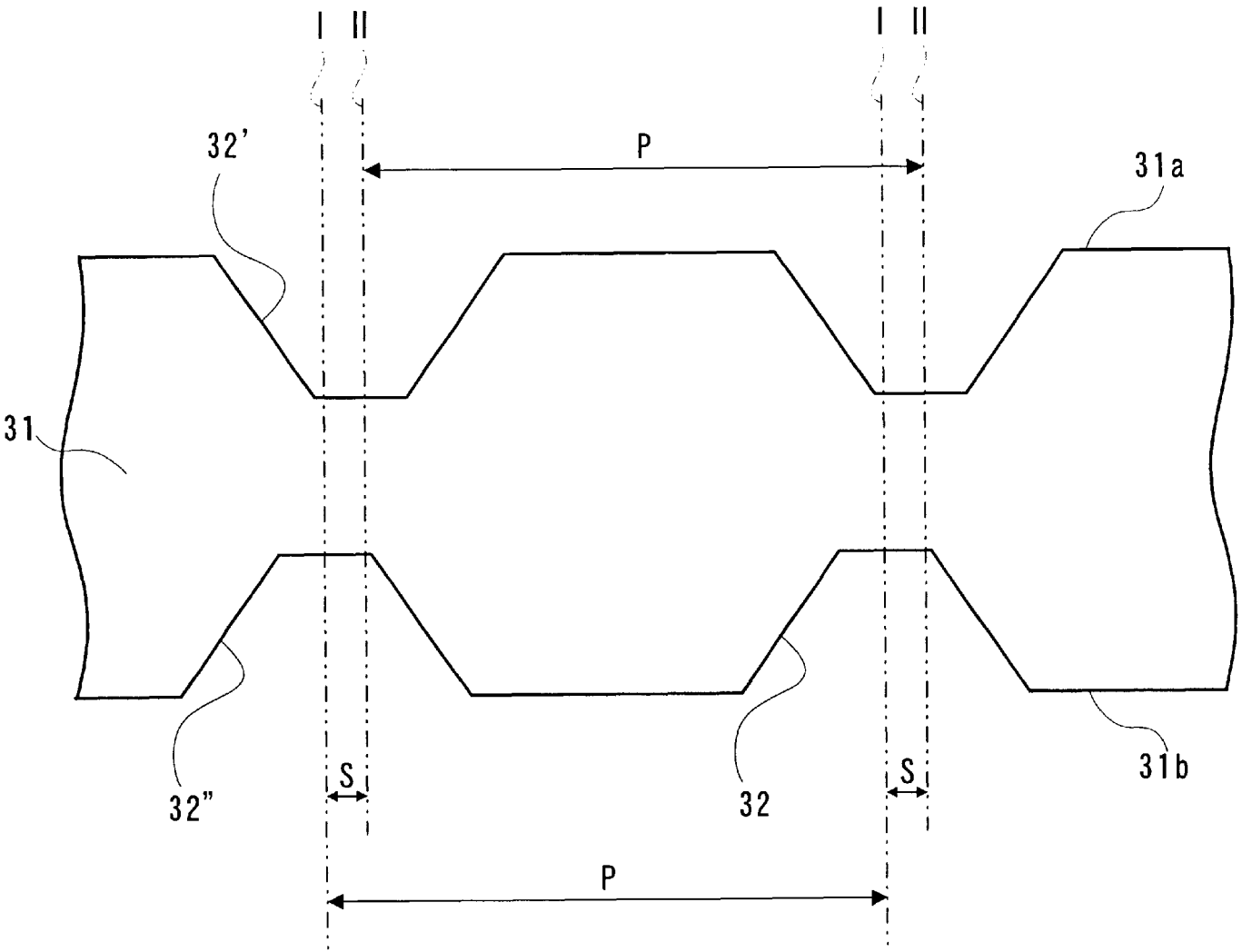
FIG. 4 is a partial enlarged view showing a part of the substrate shown in FIG. 3.

FIG. 4 is a partial enlarged view showing a part of the substrates shown in FIG. 3. On the front and back sides of the substrates 31, the grooves 32 with prescribed pitch P (256 $\mu$m, for example) are formed respectively. The grooves 32 are shifted between the front and back sides by an amount of shift S (32 $\mu$m, for example) in the horizontal direction. More specifically, perpendicular II that passes through the center of a groove 32' on the front side is shifted rightward with respect to perpendicular I that passes through the center of a groove 32" on the back side.

Figure 5:
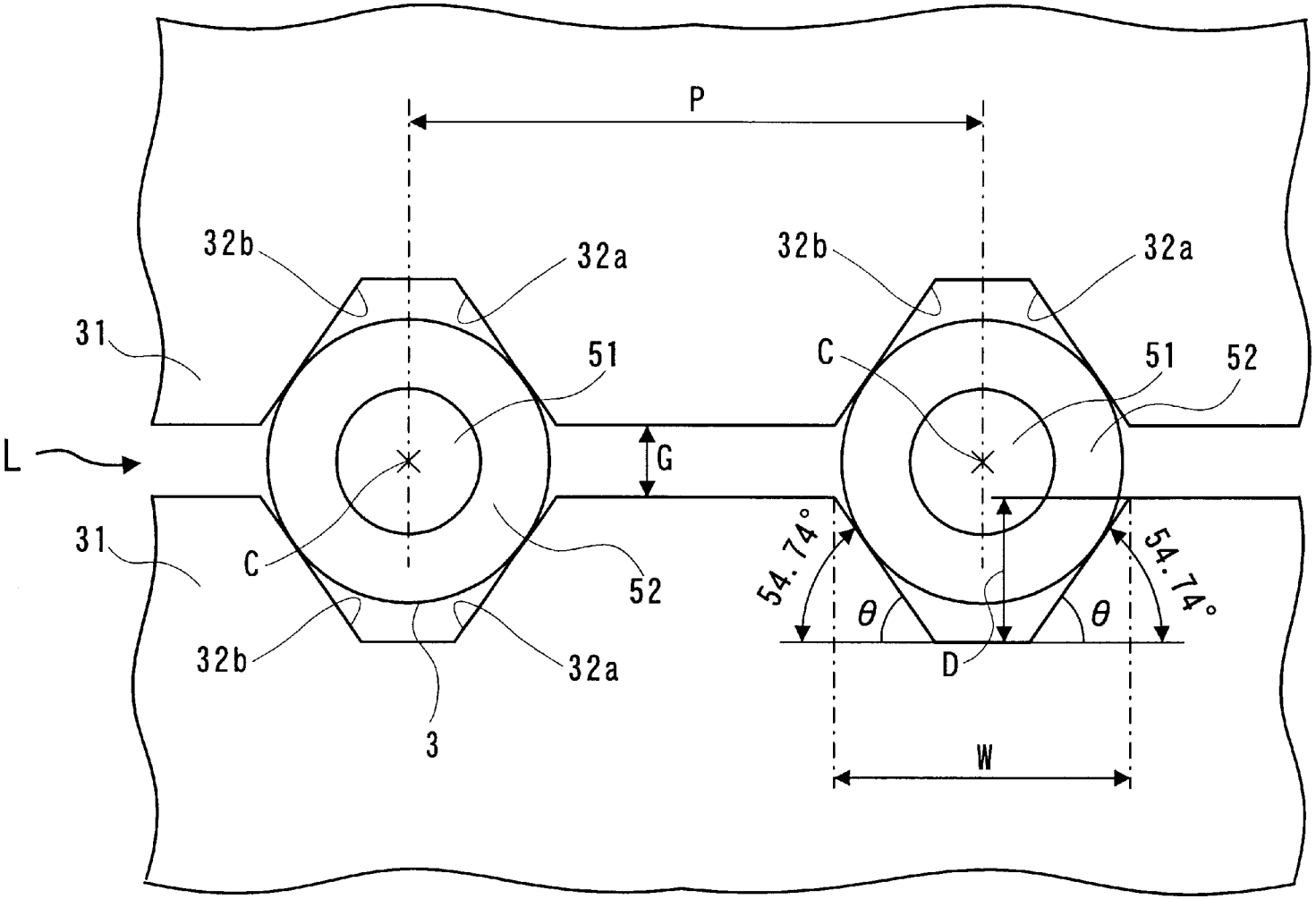
FIG. 5 is a partial enlarged view showing optical fibers inserted between the substrates in the embodiment above.

FIG. 5 shows an enlarged partial front view of optical fibers 3 inserted between substrates 31. The grooves 32 have a trapezoidal section with the opening side wider than the bottom side as shown in FIG. 5 Angle $\theta$ of inner faces 32*a* and 32*b* of the grooves 32 and width W of the opening are set in such a way that the optical fibers 3 have point contact with the inner face 32*a*. In this example, angle $\theta$ is 54.74° and width W of the opening is 130 $\mu$m for radius 62.5 $\mu$m of the optical fibers 3. When the optical fibers 3 are inserted between upper and lower substrates 31 in this way, the optical fibers 3 are fixed with 2 contacts each, a total of 4 contacts with the grooves 32. At this time, depth D of the grooves 32 is set to create gap G between two the substrates 31.

The sectional shape of the grooves 32 is not limited to a trapezoidal shape. That is, it can be any shape if it provides at least two contact points with the circumferential surface of the optical fibers 3. For example, a V shape can be used.

The fixing block 5 consisting of combined the substrates 31 above is attached to the optical fiber array 4 in such a way that the front and back sides of the substrates 31 are parallel to the axial direction of the drum 9, that is, the sub-scanning direction of the recording medium 8. That is, the fixing block 5 is attached to optical fiber array 4 in such a way that the centers of optical fibers 3 inserted between two neighboring substrates 31 are arrayed on the same line in the sub-scanning direction.

Through such the fixing block 5, the terminations 3*a* of optical fibers 3 are fixed in a matrix form. More specifically, the terminations 3*a* of the optical fibers 3 are placed on a column L1 in the sub-scanning direction of recording medium 8 and fixed so that the column L1 may be stacked in multiple stages in the main scanning direction of the recording medium 8. In this example, the matrix of the terminations 3*a* consists of 8 columns L1 in the sub-scanning direction of the recording medium 8 and 16 rows L2 in the main scanning direction of the recording medium 8 which intersect the columns L1.

A plurality of the terminations 3*a* of a plurality of the optical fibers 3 that belong to same columns L1 are arranged with pitch P (256 $\mu$m in this example). A center C of the termination 3*a* that belongs to another column L1 and same row L2 at the same time is uniformly shifted by an amount of shift S with respect to a perpendicular that passes through a center C of a termination 3*a* of one optical fiber 3 in the sub-scanning direction.

Furthermore, one termination 3*a* belonging with one column L1 is shifted by an amount of S against the other termination belonging to the other column which is one upper than the one column L1.

Between the perpendiculars that respectively pass through the center of termination 3*a* of nth optical fiber 3 and that of (n+1)the optical fiber 3 that belong to one column L1, the centers of terminations 3*a* of nth optical fiber 3 that belongs to another column L1 are put at regular interval.

The operation of the image recording apparatus of the embodiment above is explained. The semiconductor lasers 2 emits light beams driven according with image signals. The light beams generated are propagated by the optical fibers 3. The light beams are emitted from the terminations 3*a* of the optical fibers 3. The light beams emitted are reduced by the zoom lens 6 and irradiated onto the surface of the recording medium 8. The subliming dyestuff applied to the surface of the recording medium 8 is removed from the recording medium 8 by thermal energy of the light beams. The removed subliming dyestuff is suctioned by a suction means that is not shown in the figure. Every time the drum 8 makes one rotation to move the recording medium 8 one line in the main scanning direction, the linear motor 11 moves the laser head 7 by a prescribed amount in the subscanning direction of the recording medium 8. Whole the recording medium 8 is scanned by repeating this operation.

As shown in FIG. 5, optical fibers 3 consist of core 51 that transmits light beams and clad 52 that clads core 51 and light beams are emitted from core 51. Therefore, a spot by a light beam irradiated onto the surface of recording medium 8 is determined by the size of core 51.

The image recording operation is explained in detail below. An image to be recorded is distributed to each of semiconductor lasers 2 in image memory 25. During recording, a light beam is emitted from the termination 3*a* of each optical fiber 3, and the light beam is controlled so that it may be emitted always from the same position with respect to the main scanning direction. That is, with respect to column L1 to be recorded first, the light beam of next column L1 is emitted with a predetermined time delay. Likewise, light beams of subsequent columns L1 are emitted with their respective predetermined time delay from first column L1. It is necessary to adjust this delay time only once with arbitrary resolution and the delay time can be easily obtained by multiplying the original delay time by a magnification coefficient according to a variation of the magnifying of the zoom lens 6 with other resolutions.

Figure 6:
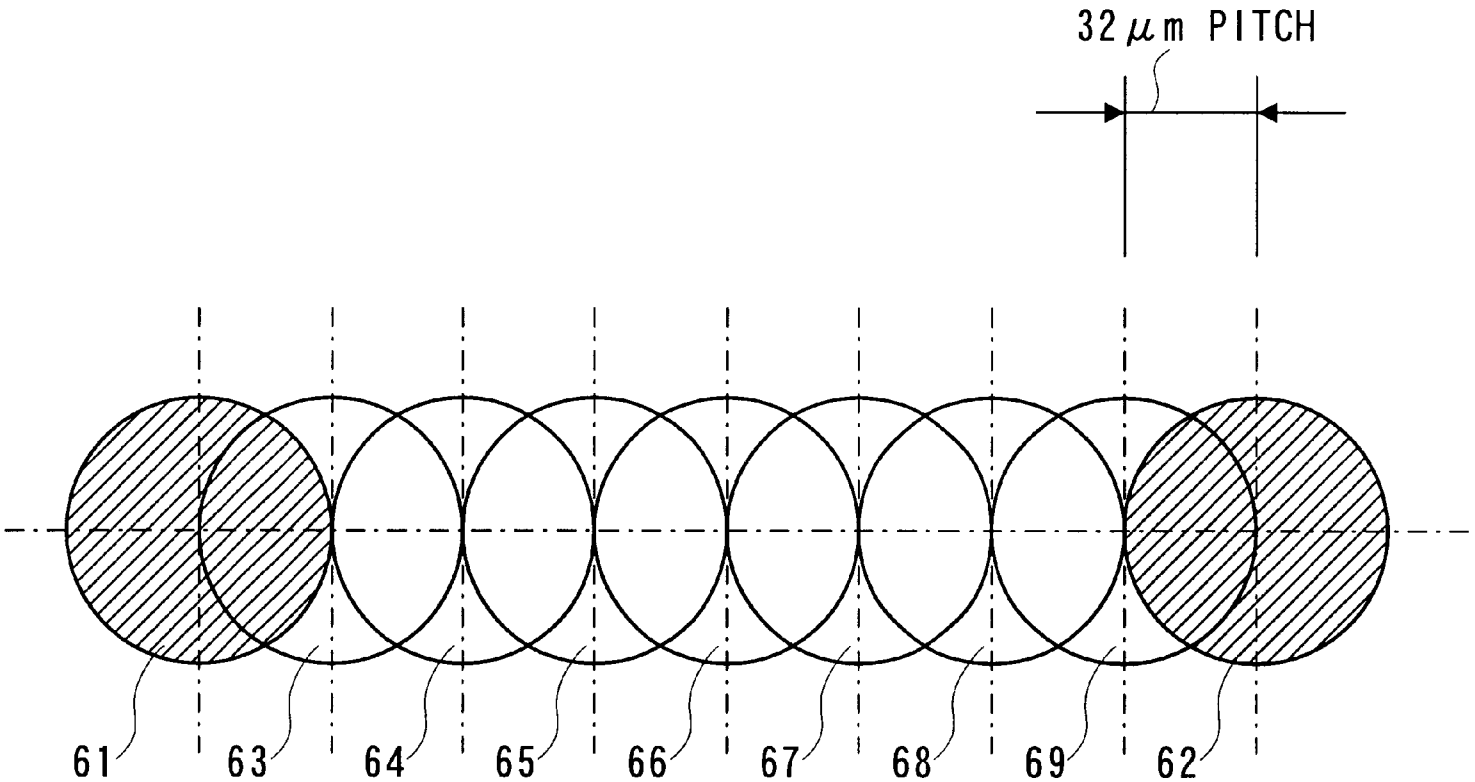
FIG. 6 is a drawing showing light beam spots irradiated a recording medium in the embodiment above.

FIG. 6 shows optical beam spots in the image recording operation above. As shown in FIG. 6, on a same column L1, slot 61 and slot 62 are irradiated by termination 3*a* of the nth optical fiber 3 from the left end and termination 3*a* of the (n+1)th optical fiber 3, respectively. If an amount of shift S of termination 3*a*, for example, pitch P of groove 32, is set to the number of optical fibers that belong to the same row L2, that is, a distance obtained by adding 1 to the number of stages, spots 63 to 69 by terminations 3*a* of all optical fibers 3 that belong to another column L1 and the same row L2 as in the case of the nth optical fiber 3 above as well are equally inserted between spots 61 and 62.

Because of such shifts of the terminations 3*a* of the optical fibers 3, the centers (hereinafter referred to as "recording points") of all spots 61 to 69 do not mutually overlap. When the magnifying of the zoom lens 6 is 1, the interval of recording points coincides with the amount of shift S and is therefore 32 $\mu$m.

At this time, by setting the amount of shift S to the radius of spots 61 to 69 or less, that is, the radius of optical fibers 3 or less, it is possible to superimpose spots 61 to 69 over the neighboring spots without tilting entire fixing block 5 containing substrates 31 as shown in FIG. 6.

The material of substrates 31 above is not limited to a particular material, but silicon is preferred in the sense that grooves 32 are easily formed to the substrate. That is, a resist mask is formed which selectively opens areas to form the grooves 32 on the surface of the silicon substrates. Then, the grooves 32 are formed by applying etching to the silicon substrates. At this time, selecting appropriate crystalline planes of the silicon substrates and/or etching conditions makes it possible to form the grooves 32 with a desired shape and size extremely easily. Depth D of the grooves 32 can also be adjusted by changing the etching processing time.

As explained above, according to image recording apparatus 1 of the embodiment of the present invention, the terminations 3*a* of the optical fibers 3 in the fixing block 5, that is, the emitters of the light beams are arranged on column L1 in the sub-scanning direction of the recording medium 8 and this column L1 is stacked in multiple stages in the main scanning direction of the recording medium 8. This can reduce the lens diameter of the zoom lens 6 compared to the case where terminations 3*a* of the same number of the optical fibers 3 are arranged in the sub-scanning direction. Stacking the terminations 3*a* of the optical fibers 3 in multiple stages also increases the number of the optical fibers 3 and increases the number of pixels recordable at a time, which will improve the recording speed.

By shifting the terminations 3*a* of the optical fibers 3 that belong to same row L2 in the sub-scanning direction, the spots 61, 63 to 69 for the recording medium 8 are irradiated on one line in the sub-scanning direction, and recording is performed on the recording medium 8. Since the recording points of the light beams irradiated on the recording medium 8 do not mutually overlap, images can be recorded on the recording medium 8 correctly.

When the terminations 3*a* of the optical fibers 3 are placed in a single row, their pitch cannot be smaller than the diameter of each of the optical fibers 3. On the contrary, according to the embodiment above, the terminations 3*a* irradiating neighboring two spots do not mutually interfere, and thus the amount of shift S can be set smaller than that in the optical fibers 3. As a result, as shown in FIG. 6, additional spots can be inserted between spots irradiated onto the recording medium by two neighboring beam sources, reducing the distance between the neighboring two recording points, which makes it possible to increase resolution. Furthermore, it is no longer necessary to rotate laser head 7 so as to tilt the substrate as in the case of conventional 1-row arrangement of terminations 3*a*.

Moreover, the terminations 3*a* of the optical fibers 3 are inserted in the grooves 32 formed in upper and lower substrates 31. This allows the grooves 32 to contact the circumferential surface of the terminations 3*a* at 4 points, and thus centers C of the terminations 3*a* are positioned by the grooves 32. Therefore, it is possible to position the terminations 3*a* precisely by forming the grooves 32 in substrates 31 precisely.

It is possible to secure 2-point contacts with the optical fibers 3 by making width W of the opening of the grooves 32 smaller than the diameter of the optical fibers 3.

Furthermore, by providing inner faces 32*a* and 32*b* of the grooves 32 with a slope outward and widening the width of the grooves 32 toward the opening side, in other words, by making an angle θ of inner faces 32*a* and 32*b* an acute angle, the optical fibers 3 smoothly fit in the grooves 32, making it easier to position the terminations 3*a* of the optical fibers 3.

Making depth D of the grooves 32 smaller than the radius of the optical fibers 3 creates gap G between upper and lower substrates 31 when the optical fibers 3 are inserted between them. This gap G can buffer errors in the shape accuracy of the grooves 32.

Furthermore, forming the grooves 32 on both upper and lower substrates 31 reduces the entire thickness in the stacking direction of the fixing block 5, making it possible to reduce the size of the fixing block 5.

As shown in this example, if silicon is used as the material of the substrates 31, the grooves of a desired shape and size can easily be formed in the substrates 31 using what is called photolithographic technology, making it possible to manufacture the laser head 7 easily and with high precision.

As shown in FIG. 4, a plurality of identical substrates 31 are provided which have the grooves 32 formed in such a way that perpendiculars I and II that pass through the centers of front side 31*a* and back side 31*b* of the substrates 31 respectively are shifted by an amount of shift S. Stacking the substrates 31 one by one and inserting the terminations 3*a* of the optical fibers 3 in the grooves 32 of two neighboring substrates 31 obtains a matrix structure with the terminations 3*a* of the optical fibers 3 shifted in the main scanning direction. Forming the grooves 32 with shift between the front and back sides makes it possible to manufacture the laser head 7 easily and with high precision without the need for positioning the optical fibers 3.

On top of that, what is needed is just to prepare multiple substrates 31 with the grooves 32 formed in the same size, same shape and same position, which will suppress an increase in the number of types of parts, reducing manufacturing costs. Making the substrates 31 of silicon and forming the grooves 32 using photo etching has an advantage that it is just enough to have a single mask pattern.

In the embodiment above, the grooves 32 are formed in the fixing block 5 in such a way that the terminations 3*a* of the optical fiber 3 are shifted between the upper and lower stages in the sub-scanning direction. However, it is also possible to array all grooves formed in the fixing block 5 on a same perpendicular. In this case, in order to shift the grooves in the sub-scanning direction, the fixing block 5 can also be attached to the optical fiber array 4 at an angle resulting in a matrix structure similar to the aforementioned one.

Figure 7:
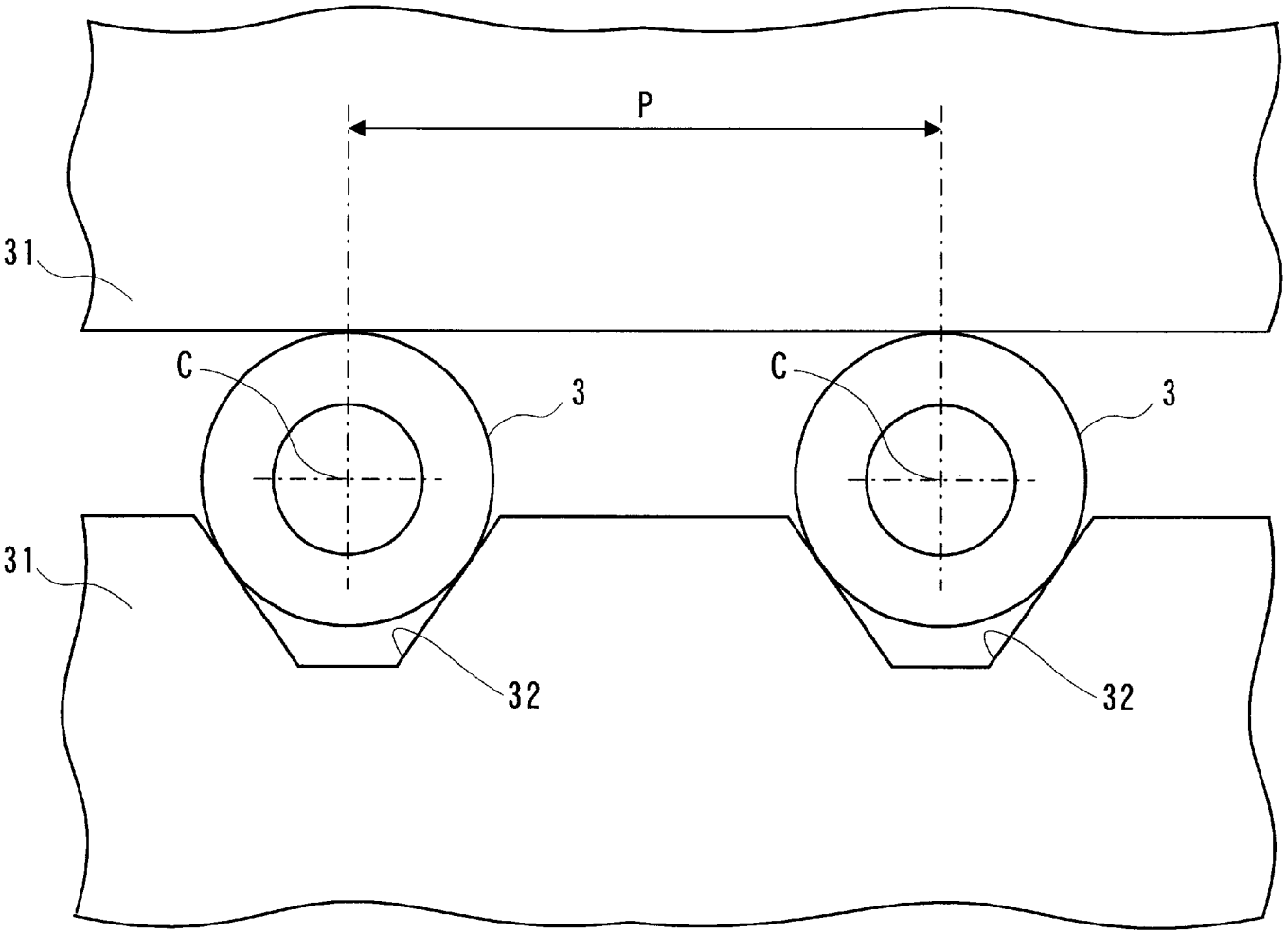
FIG. 7 shows a variation example of the image recording apparatus of the embodiment above.

Further, in the embodiment above, the grooves 32 to fix the optical fibers 3 are formed in both upper and lower substrates 31. However, as shown in FIG. 7, the grooves 32 can also be formed only on one side, lower substrates 32, for example. In this case, the optical fibers 3 have contact with the grooves 32 only at 2 points, allowing the centers C of the optical fibers 3 to be positioned precisely.

The embodiment above explained about terminations 3*a* that emit the light beams generated by the semiconductor lasers 2 as the beam sources and propagated through the optical fibers 3. However, the present invention also includes an image recording apparatus using a type of recording head that emits light beams directly from LED using light emitting diodes (LED), etc. as the beam sources.

In the embodiment above, the terminations 3*a* of the optical fibers 3 are shifted in the same direction sequentially according to their order in the column L1. However, the present invention is not limited to this and the optical fibers 3 can also be arranged at random, for example. The present invention only requires that spots be arrayed on a straight line as a consequence. However, the more complicated the array, the more complicated control of semiconductor lasers 2 becomes, and hence the embodiment above is preferred most.

In the embodiments above, the image recording apparatus 1 records the image data to the recording medium coated the subliming dyestuff. However, the present invention is not limited to this embodiments. The present invention can be applied to all image recording apparatus using the light beams.

The present invention is not limited to the above described embodiments, and various variations and modifications may be possible without departing from the scope of the present invention.

This application is based on the Japanese Patent Application No.HEI10-324111 filed on Nov. 13, 1998, No.HEI10-328292 filed on Nov. 18, 1998, No.HEI10-329762 filed on Nov. 19, 1998, entire content of which is expressly incorporated by reference herein.

What is claimed is:

1. An image recording apparatus, comprising:

a light beam generator that generates a plurality of light beams in accordance with image data, to record the image data on a recording medium;

at least three sets, each comprising a plurality of optical fibers that propagate the plurality of light beams from the light beam generator to the image recording medium, the plurality of optical fibers being aligned in a sub-scanning direction of the image recording medium; and a fixing member that fixes an end of the plurality of optical fibers at an image recording medium side where the plurality of light beams are emitted toward the recording medium, the fixing member including at least four substantially identical flat members that hold the end of the plurality of optical fibers, each of the at least four flat members including an upper surface and a lower surface, each of the upper and lower surfaces including grooves spaced along the sub-scanning direction of the image recording medium to determine the position of the end of the plurality of optical fibers, the at least four flat members being stacked adjacent to each other in a main scanning direction of the image recording medium;

wherein the grooves provided in the upper surface of one flat member are shifted with respect to the grooves provided in the lower surface of the one flat member in the sub-scanning direction and the at least four flat members are stacked adjacent to each other so that the grooves in the lower surface of one of the at least four flat members face and are aligned with the grooves in the upper surface of an adjacent one of the at least four flat members in the sub-scanning direction, wherein an optical fiber of each set of the plurality of optical fibers is held between facing grooves, and wherein each set of the plurality of optical fibers is held between two adjacent flat members of the at least four flat members so that the at least three sets of the optical fibers are located at different positions in the sub-scanning direction.

2. The image recording apparatus according to claim 1, wherein an n-th optical fiber in a predetermined set of the plurality of optical fibers is positioned between an n-th and (n+1)-th optical fibers in a set of the plurality of optical fibers adjacent to the predetermined set of the plurality of optical fibers in the sub-scanning direction so that, during printing, a pixel formed by the n-th optical fiber in the predetermined set of the plurality of optical fibers is positioned between a n-th pixel and a (n+1)-th pixel formed by the n-th optical fiber and the (n+1)-th optical fiber in the set of the plurality of optical fibers adjacent to the predetermined set of the plurality of optical fibers in a predetermined line of the sub-scanning direction.

3. An image recording head, comprising:

at least three sets, each having a plurality of optical fibers that propagate a plurality of light beams emitted from a light beam generator in accordance with image data, to record the image data on a recording medium, the plurality of optical fibers being aligned in a sub-scanning direction of the image recording medium; and a fixing member that fixes an end of the plurality of optical fibers at an image recording medium side where the plurality of light beams are emitted toward the recording medium, the fixing member including at least four substantially identical flat members that hold the end of the plurality of optical fibers, each of the at least four flat members including an upper surface and a lower surface, each of the upper and lower surfaces including grooves spaced along the sub-scanning direction of the image recording medium to determine the position of the end of the plurality of optical fibers, the at least four flat members being stacked adjacent to each other in a main scanning direction of the image recording medium;

wherein the grooves provided in the upper surface of one flat member are shifted with respect to the grooves provided in the lower surface of the one flat member in the sub-scanning direction and the at least four flat members are stacked adjacent to each other so that the grooves in the lower surface of one of the at least two flat members face and are aligned with the grooves in the upper surface of an adjacent one of the at least four flat members in the sub-scanning direction, wherein an optical fiber of each set of the plurality of optical fibers is held between a facing grooves, and wherein each set of the plurality of optical fibers is held between two adjacent flat members of the at least four flat members so that the at least three sets of the optical fibers are located at different positions in the sub-scanning direction.

4. The image recording head according to claim 3, wherein an n-th optical fiber in a predetermined set of the plurality of optical fibers is positioned between an n-th and (n+1)-th optical fibers in a set of the plurality of optical fibers adjacent to the predetermined set of the plurality of optical fibers in the sub-scanning direction so that, during printing, a pixel formed by the n-th optical fiber in the predetermined set of the plurality of optical fibers is positioned between a n-th pixel and a (n+1)-th pixel formed by the n-th optical fiber and the (n+1)-th optical fiber in the set of the plurality of optical fibers adjacent to the predetermined set of the plurality of optical fibers in a predetermined line of the sub-scanning direction.

5. A method for manufacturing an image recording head using at least four substantially identical flat members each having an upper surface and a lower surface, the upper and lower surfaces each including grooves spaced along a sub-scanning direction of an image recording medium, the grooves provided in the upper surface being shifted with respect to the grooves provided in the lower surface in the sub-scanning direction, the method comprising:

stacking the at least four flat members adjacent to each other in a main scanning direction so that the grooves in the lower surface of one of the at least four flat members face and are aligned with the grooves in the upper surface of an adjacent one of the at least four flat members in the sub-scanning direction; and holding each of at least three sets, each set, comprising a plurality of optical fibers configured to be spaced along in the sub-scanning direction between the grooves in the lower surface of one of the at least four flat members and the grooves in the upper surface of an adjacent one of the at least four flat members, wherein each set of the plurality of optical fibers is held between two adjacent flat members of the at least four flat members so that the at least three sets of the optical fibers are located at different positions in the sub-scannnig direction, wherein an optical fiber of each set of the plurality of optical fibers is held between facing grooves.

* * * * *

UNITED STATES PATENT AND TRADEMARK OFFICE

CERTIFICATE OF CORRECTION

PATENT NO. : 6,330,019 B1
DATED : December 11, 2001
INVENTOR(S) : H. Kubokawa

It is certified that error appears in the above-identified patent and that said Letters Patent is hereby corrected as shown below:

Column 10,
Line 23, “scannnig” should be -- scanning --.

Signed and Sealed this

Sixteenth Day of July, 2002

*Attest:*

*Attesting Officer*

JAMES E. ROGAN
*Director of the United States Patent and Trademark Office*